US009554606B2

(12) United States Patent
Ratner et al.

(10) Patent No.: US 9,554,606 B2
(45) Date of Patent: Jan. 31, 2017

(54) PROTECTIVE HEADWEAR ASSEMBLY HAVING A BUILT-IN CAMERA

(71) Applicant: C-Preme Limited LLC, Torrance, CA (US)

(72) Inventors: Corey Ratner, Venice, CA (US); Ryan Ratner, Venice, CA (US); Conan Hayes, Venice, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 309 days.

(21) Appl. No.: 14/030,406

(22) Filed: Sep. 18, 2013

(65) Prior Publication Data

US 2014/0075655 A1 Mar. 20, 2014

Related U.S. Application Data

(60) Provisional application No. 61/702,739, filed on Sep. 18, 2012.

(51) Int. Cl.
*A42B 3/04* (2006.01)

(52) U.S. Cl.
CPC ..... *A42B 3/042* (2013.01)

(58) Field of Classification Search
CPC ..... A42B 3/04; A42B 3/042; A42B 3/0426; H04N 5/2252; H04N 7/183; G02C 11/10; G02C 345/08; G11B 20/10
USPC ..... 2/410, 424, 422; 348/81, 82, 115, 143; 345/7, 8
See application file for complete search history.

(56) References Cited

U.S. PATENT DOCUMENTS

| | | | | |
|---|---|---|---|---|
| 4,786,966 | A | 11/1988 | Hanson et al. | |
| 4,797,736 | A | 1/1989 | Kloots et al. | |
| 4,970,589 | A | 11/1990 | Hanson et al. | |
| 5,035,474 | A | 7/1991 | Moss et al. | |
| 5,089,914 | A | 2/1992 | Prescott | |
| 5,322,245 | A | 6/1994 | Bassick | |
| 5,584,073 | A | 12/1996 | Radzelovage et al. | |
| 5,886,739 | A * | 3/1999 | Winningstad | H04N 7/185 348/115 |
| 6,028,627 | A | 2/2000 | Helmsderfer | |
| 6,292,213 | B1 | 9/2001 | Jones | |
| 6,342,915 | B1 | 1/2002 | Ozaki et al. | |
| 6,456,261 | B1 * | 9/2002 | Zhang | A42B 3/042 345/7 |
| 6,476,391 | B1 | 11/2002 | Zhang | |
| 6,606,114 | B1 | 8/2003 | Gordon et al. | |
| 6,704,044 | B1 | 3/2004 | Foster et al. | |

(Continued)

FOREIGN PATENT DOCUMENTS

| | | |
|---|---|---|
| DE | 19542835 A1 | 5/1997 |
| EP | 0475679 | 3/1992 |

(Continued)

*Primary Examiner* — Gloria Hale
(74) *Attorney, Agent, or Firm* — Booth Udall Fuller, PLC

(57) ABSTRACT

A protective headwear assembly is provided having a built-in camera, including a camera lens disposed in a front portion thereof. The camera lens is configured to provide a downward orientation relative to a horizontal plane of the headwear so that the camera captures imaging near the feet of the wearer. In an exemplary embodiment, the headwear is adapted for use by skateboarders and provides, among other things, for the recording of tricks and feet placement/technique. The camera lens can be pivotally mounted to an outer shell of the headwear assembly.

25 Claims, 11 Drawing Sheets

(56) References Cited

U.S. PATENT DOCUMENTS 6,717,737 B1 4/2004 Haglund
6,819,354 B1 * 11/2004 Foster ..... H04N 7/183 348/157
6,859,327 B2 2/2005 Bianco et al.
7,095,025 B2 8/2006 Reilly et al.
7,105,796 B2 9/2006 Lewis et al.
7,170,058 B2 1/2007 Miyano et al.
7,186,159 B1 * 3/2007 Baxter ..... A42B 1/12 2/422
7,234,812 B2 6/2007 Piorkowski et al.
7,369,174 B2 5/2008 Olita et al.
7,460,304 B1 12/2008 Epstein et al.
7,483,485 B2 * 1/2009 Winningstad ..... H04M 1/05 348/143
7,559,648 B2 * 7/2009 Velazquez ..... G02C 11/10 351/158
7,570,301 B2 8/2009 Gilor
7,576,800 B2 8/2009 Swain
7,598,928 B1 10/2009 Buskop
7,750,301 B1 7/2010 Woolaway et al.
8,009,229 B1 * 8/2011 Peterson ..... A42B 3/042 345/8
8,120,651 B2 2/2012 Ennis
8,279,277 B2 10/2012 Nam et al.
8,531,592 B2 9/2013 Teetzel et al.
2002/0053101 A1 5/2002 Slack
2002/0186180 A1 12/2002 Duda
2003/0025792 A1 2/2003 Eberhard
2004/0165109 A1 8/2004 Lee
2005/0060793 A1 3/2005 Rosie
2006/0277666 A1 * 12/2006 Gertsch ..... A42B 3/04 2/424
2007/0022520 A1 2/2007 Grassl et al.
2007/0271687 A1 * 11/2007 Zhou ..... A42B 3/0426 2/410
2008/0068825 A1 3/2008 Harris
2008/0131106 A1 6/2008 Bruce
2008/0192114 A1 * 8/2008 Pearson ..... H04N 5/2252 348/81
2008/0239080 A1 10/2008 Moscato
2009/0059063 A1 3/2009 Gallagher
2009/0231423 A1 * 9/2009 Becker ..... A61F 9/06 348/82
2009/0231426 A1 * 9/2009 Haraguchi ..... G11B 20/10 348/143
2010/0302356 A1 12/2010 Sinivaara
2011/0112519 A1 * 5/2011 Donitzky ..... A61F 9/00836 606/4
2011/0261176 A1 10/2011 Monaghan, Sr. et al.
2012/0033142 A1 * 2/2012 Thomson ..... G02B 7/002 348/838
2012/0050607 A1 3/2012 Sims et al.
2012/0249797 A1 10/2012 Haddick et al.
2013/0128046 A1 5/2013 Gindin
2014/0075655 A1 3/2014 Ratner et al.
2014/0075658 A1 * 3/2014 McGuin ..... A61F 5/0111 2/455

FOREIGN PATENT DOCUMENTS

EP 0622030 11/1994
EP 1300716 4/2003
EP 2082656 A1 7/2009
GB 2251780 A 7/1992
GB 2299744 A 10/1996
WO WO 2009/079656 6/2009

* cited by examiner

PROTECTIVE HEADWEAR ASSEMBLY HAVING A BUILT-IN CAMERA

CROSS REFERENCE TO RELATED APPLICATION

This application claims the benefit of U.S. Provisional App. No. 61/702,739, filed Sep. 18, 2012, which is incorporated by reference

FIELD OF THE INVENTION

The present invention relates to protective headwear and, more particularly, to protective headwear with an integrated video camera.

BACKGROUND OF THE INVENTION

Headwear are commonly used in a variety of alternative sports such as skateboarding, snowboarding, and rock-climbing. Generally, helmets are comprised of a hard outer shell usually made of plastic, and a cushioned inner layer usually made of foam or padding. Such helmets are made to withstand an anticipated level of impact, but light enough to not be restrictive for movement for the specified activity.

Participants in such sports enjoy video recording while engaged in an activity. Usually, another person would have to be present to record the participant. Although this type of video recording may be preferable, there are instances in alternative sports activities when it is difficult or inconvenient. For example, in certain activities such as snowboarding or rock-climbing, it may be difficult for the person video recording to be able to follow continuously the participant during the entire activity. Moreover, certain participants may prefer to video record the activity in their own perspective, not the perspective of another person. However, due to the nature of some activities, it may not be feasible, if not impossible, for the participant to be holding a video camera in their hands while engaging in that activity. Therefore, there is a need for a way for an individual engaging in an activity to video record it without having to hold a recording device.

To address this need, cameras that mount on helmets have been made known in the prior art. Commonly, the camera is separate from the helmet and is attached to the external shell of the helmet by a special mount or connector. However, this approach often significantly increases the overall weight of the helmet or creates an uneven distribution of weight that may cause a sense of imbalance. In alternative sports such as skateboarding, a participant wearing a heavy or disproportionately weighted helmet may be encumbered from doing tricks and special maneuvers that require absolute balance.

In addition, cameras that mount onto helmets protrude outwardly and may hinder the participant. For activities that require the participant to travel at high speeds, the protruding camera can cause wind resistance, creating drag and strain on the participant's head. A protruding camera can also be dangerous because there is a greater chance that it may be entangled or come into contact with something during the activity. Furthermore, expensive camera equipment is more likely to become damaged if it is protruding outwardly from a helmet.

Furthermore, the camera placement may give an undesired point of view. When cameras are mounted on the top of a helmet, the point of view may be directed too far into the distance. In other words, the participant's point of view at his eyelevel may be substantially different from the point of view several inches above eye level.

Moreover, cameras with a fixed field of view may not be desirable for some alternative sports. Within a single alternative sport, there are many subcategories of distinctly different activities. For example, there are many variations of skateboarding such as downhill longboarding, freestyle, street, and vert ("vertical") skateboarding. Each subcategory of skateboard requires a different field of view for recording. For instance, downhill longboarding, where a skateboarder rides down a steep hill at high speeds, a field of view nearly parallel to the horizontal plane of a helmet is required see into the distance. In contrast, vert skateboarding, where a skateboarder rides on a half-pipe ramp, a view nearly perpendicular to the horizontal plane of the helmet is required to see the ramp below the participant's feet.

In addition, for street or freestyle skateboarding, where a skateboarder rides at an outdoor or "street" environment, a plurality of perspectives required depending on the type of "trick" the skateboarder is recording. Street or freestyle skateboarding is often a fluid improvisation of a series of tricks based obstacles in the environment. Therefore, there is a need for a headwear with an built-in camera to provide a plurality of perspectives, as well as allow a user to quickly and change the camera perspective during the course of skateboarding.

It should, therefore, be appreciated that there is a need for headwear with an built-in camera providing plurality of perspectives, particularly a downward orientation relative to a horizontal plane of the headwear.

SUMMARY OF THE INVENTION

Briefly, and in general terms, the invention provides a protective headwear assembly having a built-in camera. More specifically, the camera lens is disposed in the front portion of the headwear, enabled to provide a downward orientation relative to a horizontal plane of the headwear so that the camera captures imaging near the feet of the wearer. In an exemplary embodiment, the headwear is adapted for use by skateboarders and provides, among other things, for the recording of tricks and feet placement/technique.

More specifically, by example, and not limitation, the headwear includes a hard outer shell formed of an impact resistant material such as ABS (acrylonitrile butadiene styrene) plastic, and an interior cushion shell formed of padding such as EPS (expanded polystyrene) foam. The camera lens is attached to an inner surface of the outer shell oriented to extend through an aperture defined by the outer shell. The camera lens is electronically coupled to a recording device.

In a detailed aspect of an exemplary embodiment, the headwear includes at least two buttons along the side of the headwear to enable the wearer to operate the camera. More particularly, the buttons include a "power" button, which turns the device on or off, and a "shoot" button, which starts and stops the video recording. The buttons are approximately ten millimeters in diameter and spaced horizontally at least ten millimeters apart. The buttons are comprised of silicone mold and protrudes at least five millimeters above the outer shell of the headwear.

In another detailed aspect of an exemplary embodiment, an indicator light is located along the bottom edge of the headwear in the front portion thereof. The indicator light is solid lit when the camera is powered on, continuously blinking when recording, and not lit when the camera is off.

In yet another detailed aspect of an exemplary embodiment, the headwear includes a transmitter/receiver, such as a USB port and cable, which transmits the recorded video to a computer or a display unit.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
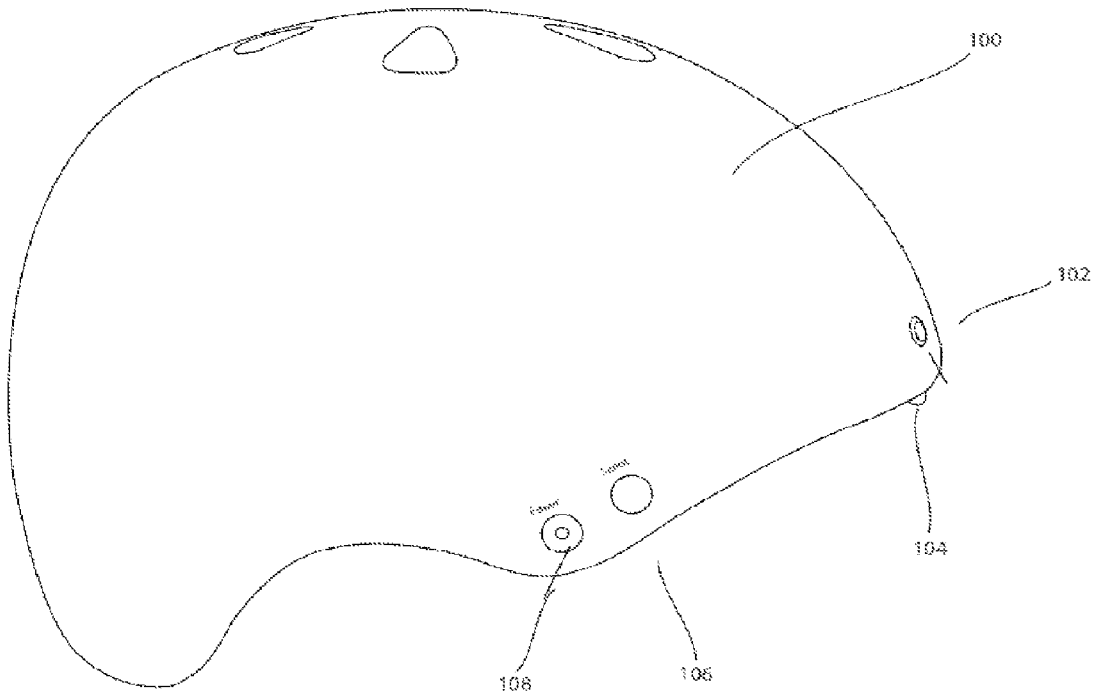
FIG. 1 is a side perspective view of a protective headwear assembly with a built-in camera in accordance with the invention.
Figure 2:
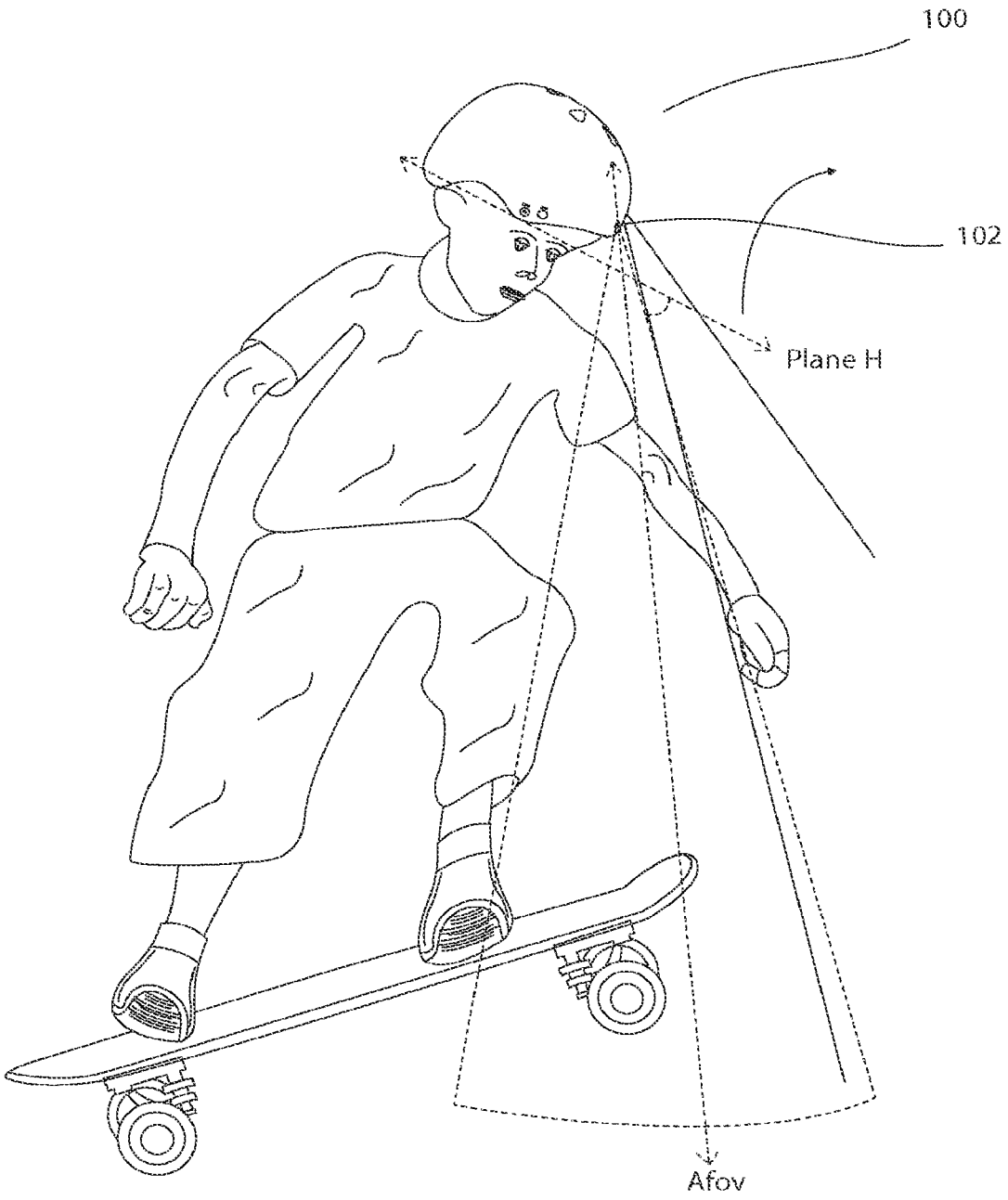
FIG. 2 is a perspective view of the protective headwear in FIG. 1, depicting the headwear on a user.

Referring now to the drawings, and particularly FIG. 1, there is shown a protective headwear assembly (i.e., helmet 100) having an integrated, built-in video camera 102 disposed in the front portion of the headwear. The video camera 102 is located approximately in the center of the front portion of the headwear. As best seen in FIG. 2, the camera is configured to have a field-of-view directed in a downward orientation relative to a horizontal plane of correlating to a wearer's eye level, when worn, which can enable the camera to capture imaging near the feet of the wearer.

The camera lens 102 is attached to an inner surface of the outer shell 112 oriented to extend through an aperture defined by the outer shell. An indicator light 104 is disposed in the front portion of the helmet 100, proximate to the video camera 102. The indicator light 104 is located along the bottom of the arcuate edge of the front portion of the helmet, visible in the user's peripheral field of view when the headwear is worn. In an exemplary embodiment, the helmet 100 is adapted for use by skateboarders and has hard outer shell formed of an impact resistant material such as ABS (acrylonitrile butadiene styrene) plastic.

With continued reference to FIG. 1, the helmet 100 has a power button 108 and a shoot button 106 located on the lateral side of the helmet, arranged at least ten millimeters apart in distance. When the helmet is worn, the power button 108 and the shoot button are positioned on one side of the user's temple, along the lower lateral edge of the helmet.

With reference now to FIG. 2, The camera has a field of view directed downward relative to a horizontal plane of the so that the camera captures imaging near the feet of the wearer. In the exemplary embodiment, the field of view has a downward orientation of a fixed angle (Θ) of 20 degrees, which is measured from a plane (H) of correlating to a wearer's eye level, when worn, to an axis ($A_{fov}$) at that bisects the camera's field of view per design specifications. Angle (Θ) can range between 10 to 90 degrees, in various embodiments.

Figure 3:
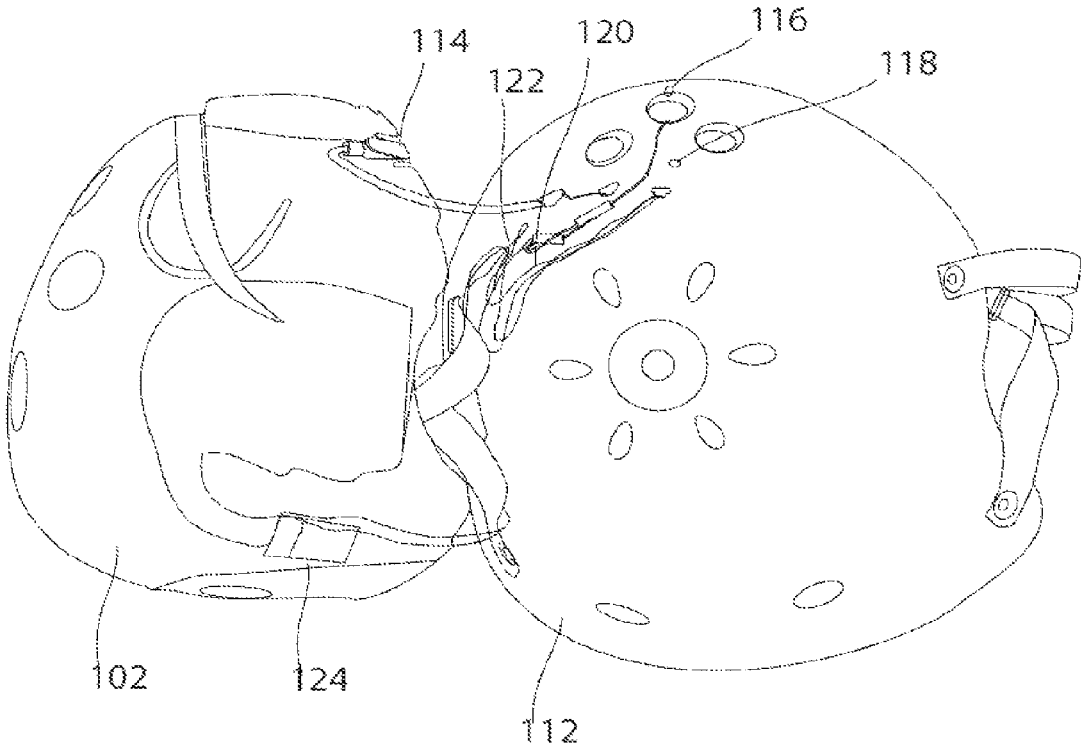
FIG. 3 is a disassembled view of the protective headwear assembly of FIG. 1, depicting the separate inner cushioned shell and outer shell of the present invention

With reference now to FIG. 3, the helmet includes a hard outer shell 112 and a cushioned inner layer 110. In an exemplary embodiment, the outer shell 112 is made of an impact resistant material such as molded ABS plastic and the inner layer 110 is made of a padding material such as EPS foam. In a detailed aspect of an exemplary embodiment, the inner layer 110 has molded channels for wires, components, and circuit boards to be fixed in.

In addition, the power and shoot buttons 122 are located on the lateral side of the outer shell 112 and electronically coupled to the circuit board assembly 120 by a connecting wire. In an exemplary embodiment, the power and shoot buttons 122 are comprised of molded silicone, approximately ten millimeters in diameter and five millimeters in height. The power button 122 includes a protrusion in the center of the button for tactile identification. The indicator light 116 is attached to the bottom ridge of the outer shell 112 and located in the front section and proximate to the forehead when worn. The video camera 118 is located in the front section, above the indicator light 116, on the surface of the outer shell 112. Both the indicator light 116 and the video camera 118 are electrically coupled to the circuit board assembly 120 by a connecting wire. The helmet has a built in universal serial bus (USB) port 140, which is electrically coupled to the circuit board assembly 120, transfers film footage to a computer through an external USB cable. A battery 124 is electrically coupled to the circuit board assembly 120 and powers all the electrical components.

Referring now to reference to FIG. 3, there is shown a circuit board assembly 142 consists of a processor 126, a memory component 128, and a battery 130. In an exemplary embodiment, the memory component 128 contains sufficient memory for several hours of video recording. In another exemplary embodiment, the memory component can be replaced and upgraded to increase the recording capacity. In yet another exemplary embodiment, the memory component utilizes compact flash cards or secure digital (SD) memory cards commonly used digital camera or camcorder devices.

In a detailed aspect of an exemplary embodiment, the battery 130 provides sufficient power for several hours of video recording. In another detailed aspect of an exemplary embodiment, the battery 130 is rechargeable and is charged through the USB port 132.

Referring again to FIG. 3, the power button 134 and shoot button 136 is electrically coupled to the processor 126 of the circuit board assembly 142. The indicator light 138 and video camera 140 are connected to the power 134 and shoot button 136 through the circuit board assembly 142. In an exemplary embodiment, by pressing the power button, instructions are sent by the processor 126 to turn on the camera 140 and set the indicator light 138 to solid light mode. When the user turns off the helmet, instructions are sent by the processor 126 to turn the indicator light 138 and camera 140 off. While the helmet is turned on, the shoot button 136 prompts the camera 140 to start recording and concurrently sets the indicator light 138 to a continuous blinking mode. When the shoot button is subsequently pressed again, the camera 140 is prompted to stop recording and the indicator light is set back to solid light mode.

In a detailed aspect of an exemplary embodiment, the circuit board contains memory 128 that is coupled to the processor 126, making it programmable to provide customizable recording features to the user, including taking still shots, changing frame rates, recording in standard or high definition, and image stabilizing features. In yet another aspect, the helmet is capable of recording metadata, including date, time, and duration of recording.

In reference again to FIG. 3, a USB port 132 is electrically coupled and separately spaced from the circuit board assembly 142. Through an external USB cable, the USB port 132 allows a user to transfer recorded videos to a computer or media player. In an exemplary embodiment, the USB port also recharges the battery 130.

With reference now to FIGS. 5-7*b*, a protective headwear assembly (helmet) 200 is shown having an integrated, built-in video camera having a camera lens 202 disposed in the front portion of the helmet. The camera lens 202 is located approximately in the center of the front portion of the helmet. More particularly, the camera is pivotally mounted to such that the camera's field of view can be adjustable oriented, to include having a field-of-view directed in a downward orientation relative to a horizontal plane of correlating to a wearer's eye level, when worn. The helmet 200 incorporates features similar to those discussed above. For example, buttons are provided along the side of the helmet to operate the cameras functionality, and circuitry and memory are disposed within the confines of the helmet.

Figure 8A:
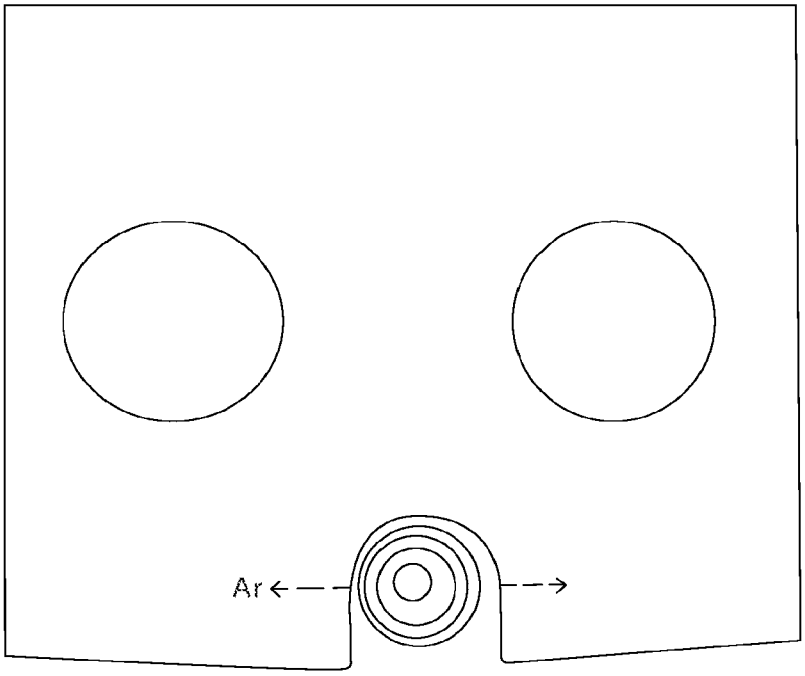
FIGS. 8*a-d* are front perspective views of the protective headwear assembly of FIG. 5, depicting the camera lens pivoted in various positions in its range of orientation.
Figure 8B:
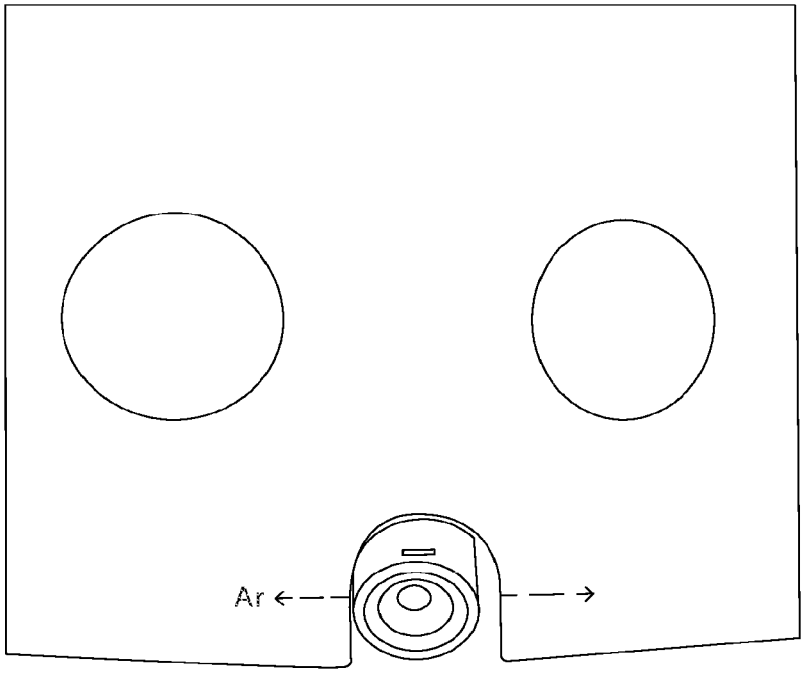
Figure 8C:
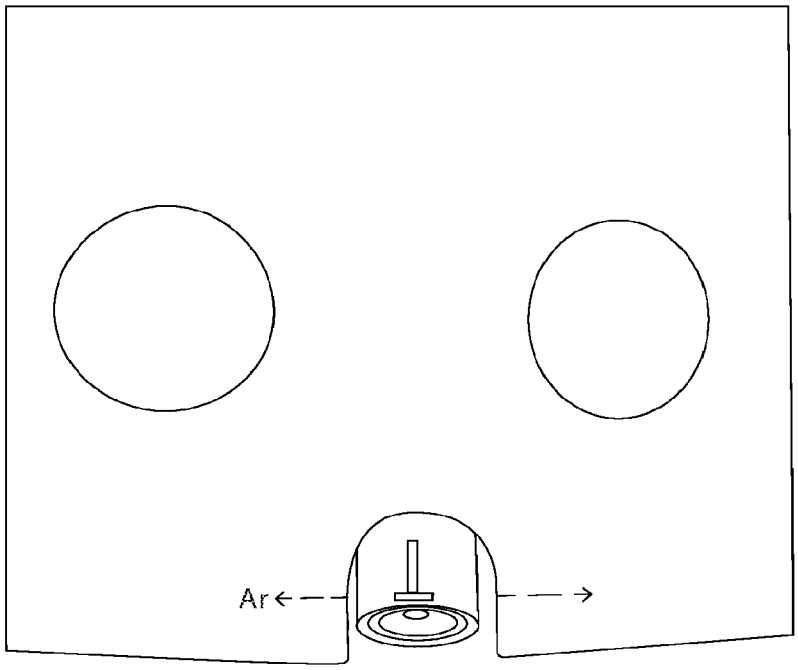
Figure 8D:
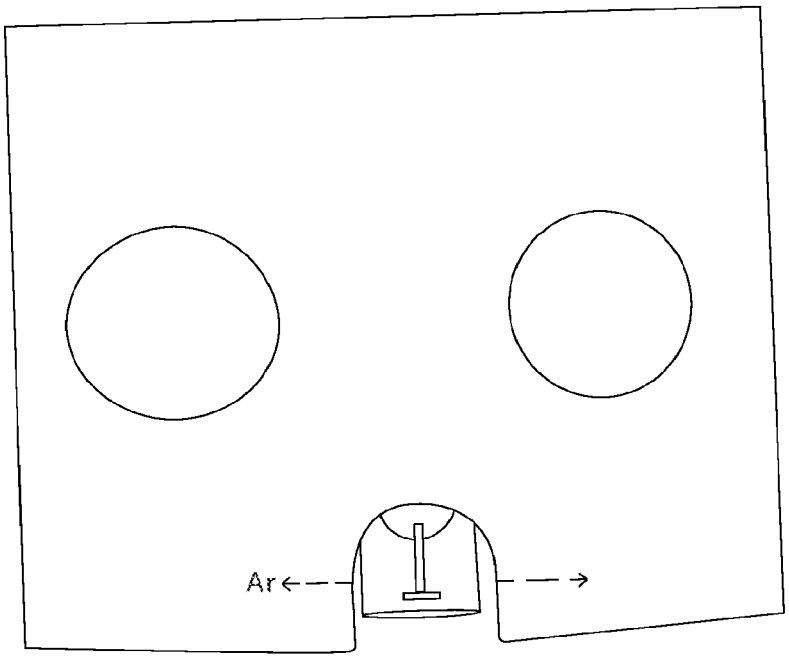
Figure 9:
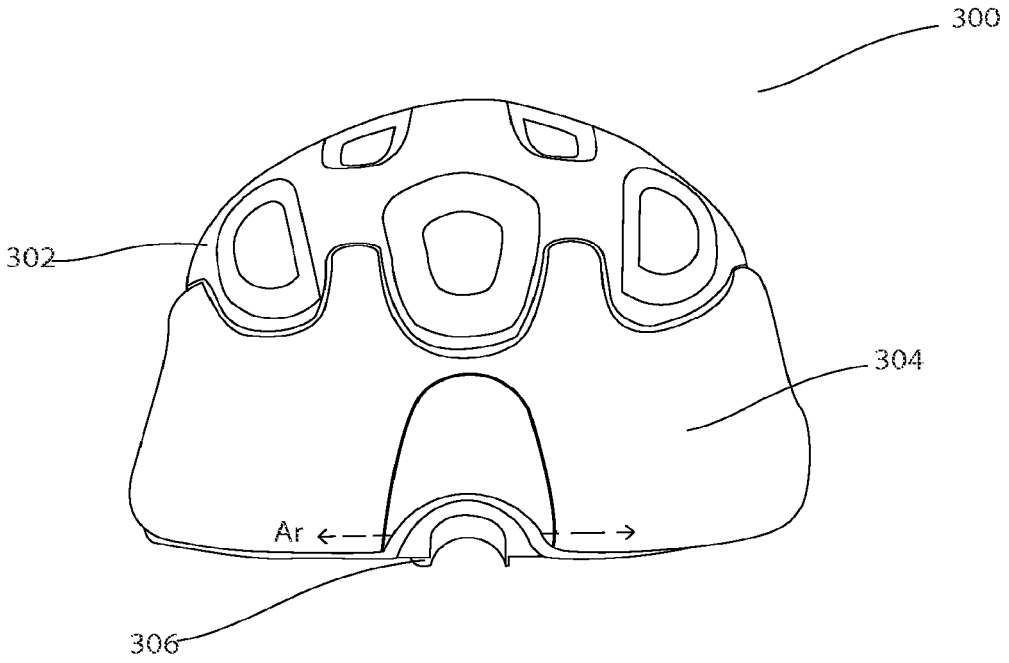
FIG. 9 is a front perspective view of a third embodiment a protective headwear assembly in accordance with the invention, depicting a helmet and a detachable visors having a pivotally mounted camera lens.

As best seen in FIGS. 8*a*-8*d*, the camera lens oriented from 0 to 90° (angle (Θ)). The camera is mounted to pivot about an axis of rotation (Ar). In FIG. 8*a*, the camera lens is oriented at an angle (Θ) of 0 degrees. In FIG. 8*b*, the camera lens is oriented at an angle (Θ) of 30 degrees. In FIG. 8*c*, the camera lens is oriented at an angle (Θ) of 60 degrees. In FIG. 8*a*, the camera lens is oriented at an angle (Θ) of 90 degrees.

The helmet 200 includes a hard outer shell 212 and a cushioned inner layer 210. The outer shell defines an opening 206 in the front portion through which the camera's field of view extends. The inner layer and the outer shell include a notched recess 208 that enables the camera to pivot through its range of motion. Moreover, the notched recess provides the user with easy access to manually adjust the orientation of the camera lens. A USB port 222 and a indicator light are bottom edge of the helmet in the front portion. The indicator light provides the wearer with convenient confirmation whether the video camera is recording, while worn.

In the exemplary embodiment the pivotal mount for the camera lens is captured between the outer shell to 212 and the inner shell 210 proximate to the notched recess 208 and the opening 206 of the outer shell. The camera lens 202 is recessed relative to the outer shell, which protects the camera lens as well as facilitates safety features of the helmet.

As a result, the wearer can adjust the camera's field of view to as desired. For example, the wearer might want to position the camera at 90° to capture the wearer's footwork or particular trick. Whereas, for other stunts the wearer might want to position the camera at 0° to capture images of obstacles as they approach.

With reference now to FIGS. 9-13, a protective headwear, i.e., detachable visor 304 having a camera lens 306 disposed in the front portion of the visor, attached to a helmet 302 (visor-helmet combination 300). The camera lens 306 is located approximately in the center of the front portion of the helmet. More particularly, the camera is pivotally mounted to such that the camera's field of view can be adjustable oriented, to include having a field-of-view directed in a downward orientation relative to a horizontal plane of correlating to a wearer's eye level, when worn.

Figure 4:
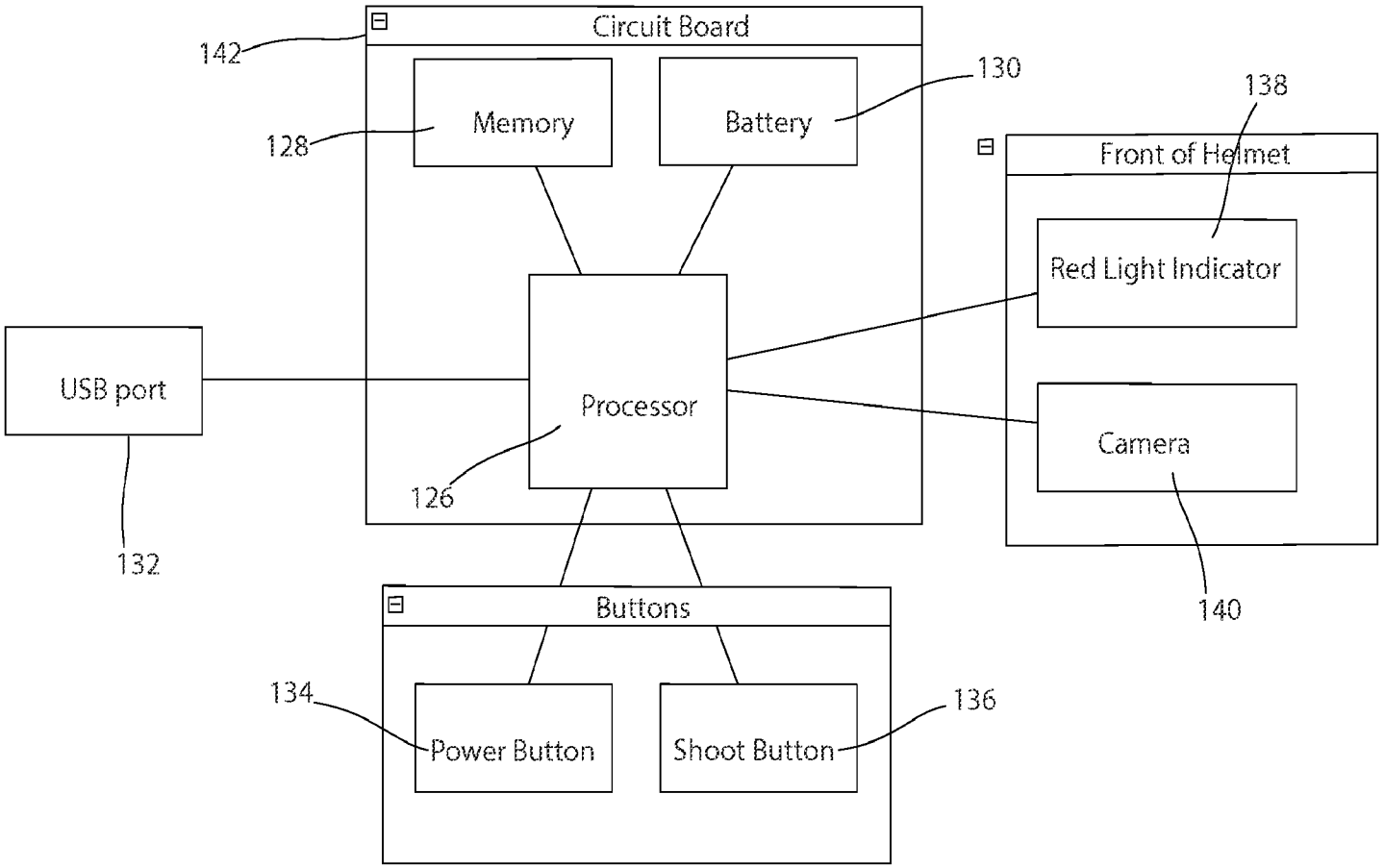
FIG. 4 is a simplified block diagram of the protective headwear assembly of FIG. 1.
Figure 5:
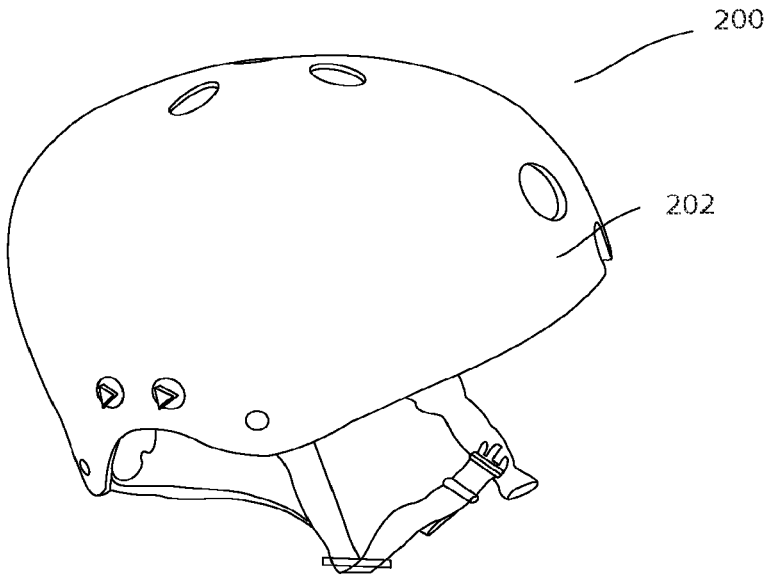
FIG. 5 is a right side perspective view of a second embodiment of a protective headwear assembly with the built-in camera in accordance with the invention, depicting a headwear having a pivotally mounted camera lens.
Figure 6:
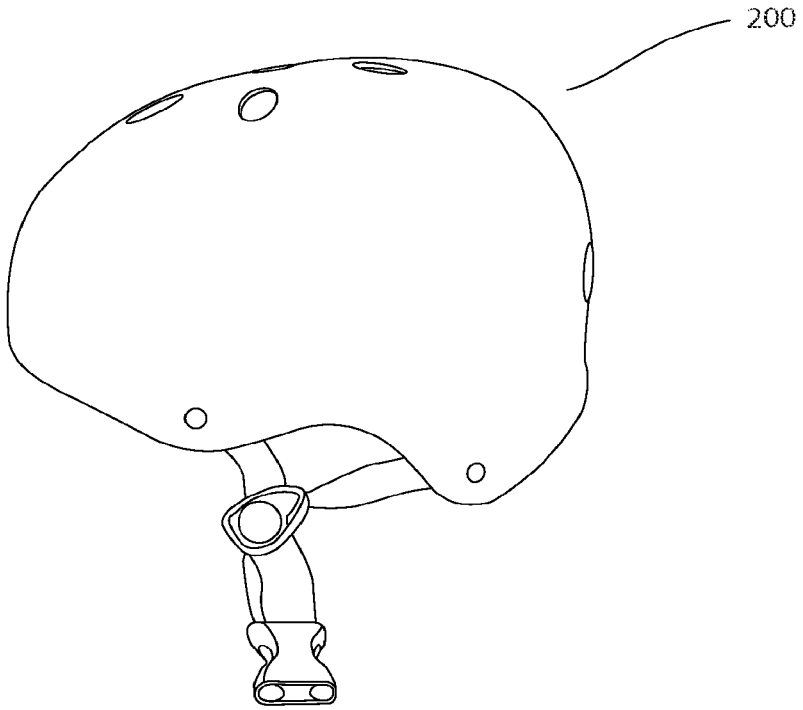
FIG. 6 is a left perspective view of the protective headwear assembly of FIG. 5.
Figure 7A:
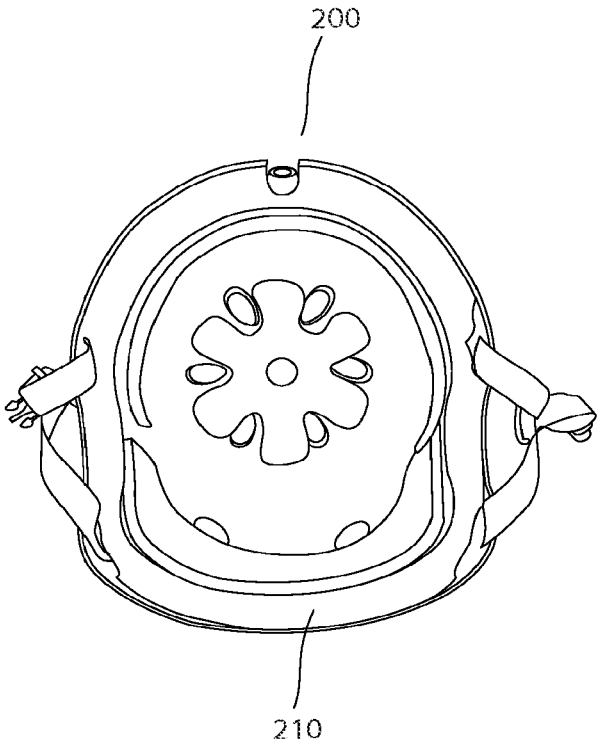
FIG. 7*a* is a bottom perspective view of the protective headwear assembly of FIG. 5.
Figure 7B:
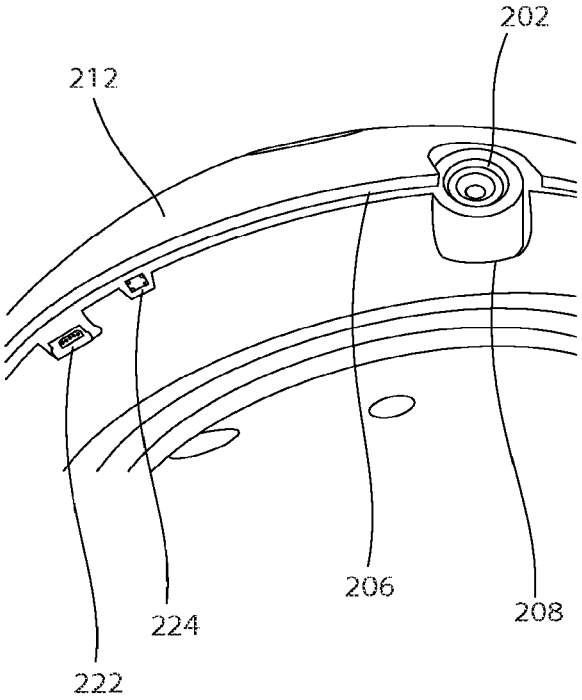
FIG. 7*b* is a close up view taken from FIG. 7*a*.
Figure 10:
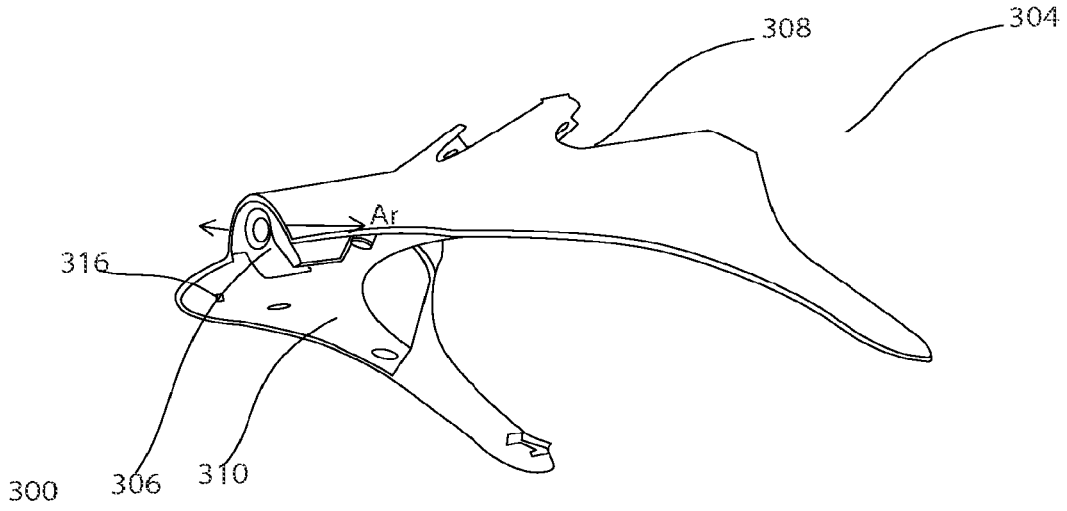
FIG. 10 perspective view of the protective headwear assembly in FIG. 9, depicting a bottom view of the visor.

As best seen in FIG. 10, The visor 304 includes an outer shell 308 having a front portion and defining an opening in the front portion thereof proximate to a bottom edge of the outer shell. The visor defines an internal cavity for securing a circuit board (e.g., FIG. 4) of the camera assembly. The internal cavity can be accessed via a removable plate 310 of the outer shell. The camera assembly includes a plurality of electrical components, including a processor, memory, battery, and USB port. In the exemplary embodiment, the removable plate is disposed along a bottom wall of the visor. The visor further includes an indicator light 316 disposed on the bottom of the visor within the field of view of the user, when worn. The light illuminates when the camera assembly is actively recording.

The camera lens 306 is mounted to pivot about an axis of rotation ($A_r$). As a result, the wearer can adjust the camera's field of view to as desired. For example, the wearer might want to position the camera at 90° to capture the wearer's footwork or particular trick. Whereas, for other stunts the wearer might want to position the camera at 0° to capture images of obstacles as they approach. The visor defines a notched recess that enables the camera to pivot through its range of motion. Moreover, the notched recess provides the user with easy access to adjust the orientation of the camera lens. In other embodiments, the camera lens can be fixed at a prescribed orientation, to include a downward orientation, as discussed above (e.g., FIG. 1).

Figure 11:
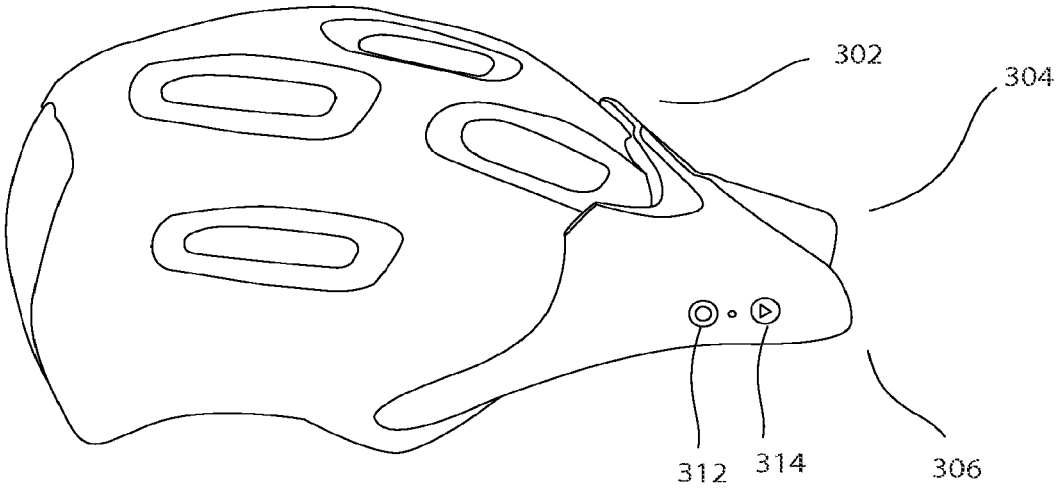
FIG. 11 is a right perspective view of the protective headwear assembly of FIG. 9.
Figure 12:
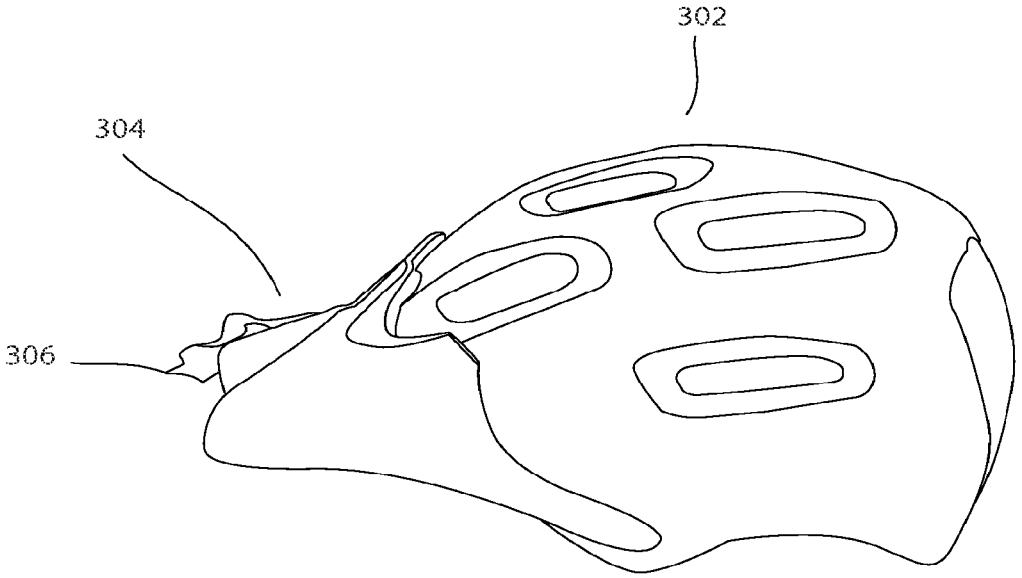
FIG. 12 is a left perspective view of the protective headwear assembly of FIG. 9.

With reference now to FIG. 11, the visor 304 includes a power button 312 and a shoot button 314 located on the lateral side thereof. The power button and the shoot button are positioned on one side of the user's temple, along the lower lateral edge of the helmet. In an exemplary embodiment, the power and shoot buttons are comprised of molded silicone, approximately ten millimeters in diameter and five millimeters in height. The power button includes a protrusion in the center of the button for tactile identification.

Figure 13:
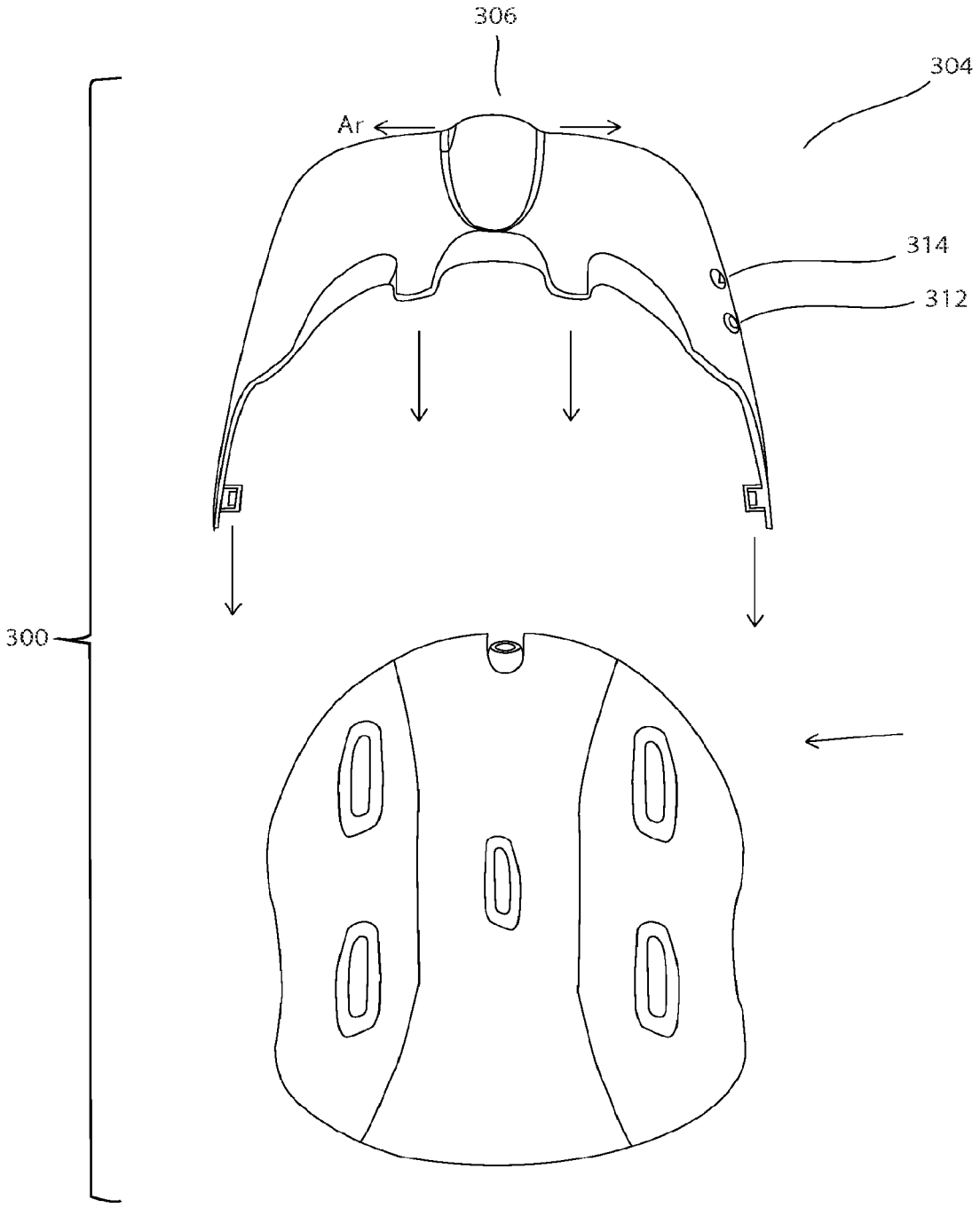
FIG. 13 is a top, partially exploded view of the protective headwear assembly of FIG. 9, depicting the visor detached from the helmet.

With reference now to FIG. 13, the visor 304 is configured to removably attach to the helmet 302. In the exemplary embodiment, the visor includes protrusions 320 that couples to the helmet in a snap-fit manner. In other embodiments, other approaches can be used for attaching the visor to the helmet.

It should be appreciated from the foregoing that the present invention provides a protective headwear assembly having an built-in camera. The camera can be provided in a downward orientation relative to a horizontal plane. The integrated camera allows unobtrusive recording without the weight and imbalance of an attached external camera. In addition, the camera can be pivotally mounted to include n a downward orientation that allows for the recording near the user's feet.

Although the invention has been disclosed in detail with reference only to the exemplary embodiments, those skilled in the art will appreciate that various other embodiments can be provided without departing from the scope of the invention. Accordingly, the invention is defined only by the claims set forth below.

What is claimed is:

1. A helmet, comprising:

an outer shell having a front portion and a first opening for placement of the assembly on a wearer's head;

a camera opening recessed within a bottom surface of the front portion;

a camera assembly having a camera lens mounted through the camera opening of the outer shell to provide a field of view that projects outwardly relative to the opening in a downward orientation; and an indicator light disposed proximate to the bottom edge of the front portion.

2. The helmet as defined in claim 1, further including a circuit board assembly disposed within the outer shell and spaced apart and electrically coupled to the camera and the indicator light.

3. The helmet as defined in claim 1, wherein buttons are disposed along a side of the headwear for operating the camera assembly.

4. The helmet as defined in claim 2, wherein the circuit board includes a plurality of electrical components, including a processor, memory, battery, and USB port.

5. The helmet as defined in claim 1, wherein the camera lens is pivotally mounted to provide an adjustable orientation.

6. The helmet as defined in claim 5, wherein the camera is adjustably oriented from 0° to 90° downwardly relative to a horizontal plane.

7. A helmet, comprising:

an outer shell having a front portion;

a camera opening recessed in the front portion; and a camera assembly having a camera lens pivotally mounted through the camera opening of the outer shell to pivot about an axis of rotation within the recessed camera opening;

wherein buttons are disposed along a side of the headwear for operating the camera assembly.

8. The helmet as defined in claim 7, wherein the camera is adjustably oriented from 0° to 90° downwardly relative to a horizontal plane.

9. The helmet as defined in claim 7, wherein the camera opening continuously extends between a bottom surface of the outer shell and an outer surface of the outer shell.

10. The helmet as defined in claim 7, further including an indicator light disposed proximate to the bottom edge of the front portion.

11. The helmet as defined in claim 10, further including a circuit board assembly disposed within a cavity defined by the outer shell and spaced apart and electrically coupled to the camera and the indicator light.

12. A helmet, comprising:

an outer shell having a front portion;

a camera opening proximate the front portion of the outer shell;

a camera assembly positioned within the camera opening and encompassed on at least three sides by the camera opening, the camera assembly having a camera lens pivotally mounted through the camera opening to pivot about an axis of rotation; and a visor that includes the camera opening within the visor.

13. The helmet as defined in claim 12, wherein the camera is adjustably oriented from 0° to 90° downwardly about the axis of rotation relative to a horizontal plane.

14. The helmet as defined in claim 12, comprising a helmet that includes the outer shell and the camera assembly, and further comprising:

an indicator light disposed proximate to the bottom edge of the front portion, the indicator light illuminates when the camera assembly is in use; and an operating button disposed along an external side of the outer shell for operating the camera assembly.

15. The helmet as defined in claim 12, wherein the camera lens is pivotally mounted such that the orientation of the camera lens is manually adjustable.

16. The helmet as defined in claim 1, wherein the camera opening continuously extends between the bottom surface of the outer shell and an outer surface of the outer shell, the camera opening further comprising a notched recess in the first opening.

17. The helmet as defined in claim 16, wherein the notched recess extends through an inner cushion shell and the camera lens is attached to an inner surface of the outer shell.

18. A helmet, comprising:

an outer shell having a front portion and a first opening for placement of the assembly on a wearer's head;

a camera opening recessed within a bottom surface of the front portion; and a camera assembly having a camera lens mounted through the camera opening of the outer shell to provide a field of view that projects outwardly relative to the opening in a downward orientation;

wherein buttons are disposed along a side of the headwear for operating the camera assembly.

19. The helmet as defined in claim 18, further including an indicator light disposed proximate to the bottom edge of the front portion and a circuit board assembly disposed within the outer shell and spaced apart from and electrically coupled to the camera and the indicator light.

20. The helmet as defined in claim 1, wherein the camera lens is pivotally mounted to provide an adjustable orientation.

21. The helmet as defined in claim 20, wherein the camera is adjustably oriented from 0° to 90° downwardly relative to a horizontal plane.

22. A helmet, comprising:

an outer shell having a front portion;

a camera opening recessed in the front portion;

a camera assembly having a camera lens pivotally mounted through the camera opening of the outer shell to pivot about an axis of rotation within the recessed camera opening; and an indicator light disposed proximate to the bottom edge of the front portion.

23. The helmet as defined in claim 22, wherein the camera is adjustably oriented from 0° to 90° downwardly relative to a horizontal plane.

24. The helmet as defined in claim 22, wherein the camera opening continuously extends between a bottom surface of the outer shell and an outer surface of the outer shell.

25. The helmet as defined in claim 22, further including a circuit board assembly disposed within a cavity defined by the outer shell and spaced apart and electrically coupled to the camera and the indicator light.

* * * * *